United States Patent [19]

Hagemann et al.

[11] Patent Number: 4,587,979

[45] Date of Patent: May 13, 1986

[54] APPARATUS FOR SUPPLYING PARTICULATE MATERIAL TO TOBACCO PROCESSING MACHINES AND THE LIKE

[75] Inventors: Fritz Hagemann, Hamburg; Hans-Jürgen Block, Wentorf; Gustav Hancke; Manfred Muss, both of Hamburg, all of Fed. Rep. of Germany

[73] Assignee: Hauni-Werke Körber & Co. KG, Hamburg, Fed. Rep. of Germany

[21] Appl. No.: 612,148

[22] Filed: May 21, 1984

[30] Foreign Application Priority Data

May 19, 1983 [DE] Fed. Rep. of Germany ..... 3318235

[51] Int. Cl.[4] ..... A24C 5/39; A24C 5/34; A24C 5/14

[52] U.S. Cl. ..... 131/110; 131/109.2; 131/909

[58] Field of Search ..... 131/109 B, 109 AB, 110, 131/108, 84 B

[56] References Cited

U.S. PATENT DOCUMENTS

| | | | |
|---|---|---|---|
| 3,386,773 | 6/1968 | Ballard, Jr. | 131/110 |
| 3,580,644 | 5/1971 | Ballard, Jr. | 131/110 |
| 3,826,065 | 7/1974 | Labbe | 131/110 |
| 4,050,741 | 9/1977 | Dickinson | 131/110 |
| 4,458,698 | 7/1984 | Brackman | 131/110 |
| 4,475,562 | 10/1984 | Thatcher et al. | 131/110 |
| 4,491,138 | 1/1985 | Labbe | 131/110 |

*Primary Examiner*—V. Millin
*Assistant Examiner*—H. Macey
*Attorney, Agent, or Firm*—Peter K. Kontler

[57] ABSTRACT

A pneumatic conveyor draws particles of tobacco from a vibrating trough by causing an air stream to flow from its intake end, which is adjacent to the trough, to its intake end which is connected to a suction generating device. A cyclone separator is installed in the conveyor to segregate the particulate material from the air stream and to discharge such material into a duct which feeds the material by gravity to an intermittently operated cell wheel evacuator. The latter drops batches of particulate material into the magazine of the distributor in a cigarette rod making machine. The conveyor has an elongated diffusor which is disposed upstream of the cyclone separator to decelerate the air stream, and such diffusor is followed by an arcuate portion whose radius of curvature is greater than the radius of the cylindrical wall surrounding the chamber of the cyclone separator. This ensures reliable separation of acceptable particulate material and evacuation of smaller particulate material, including dust, from the separator by the suction generating device.

25 Claims, 4 Drawing Figures

Fig.1
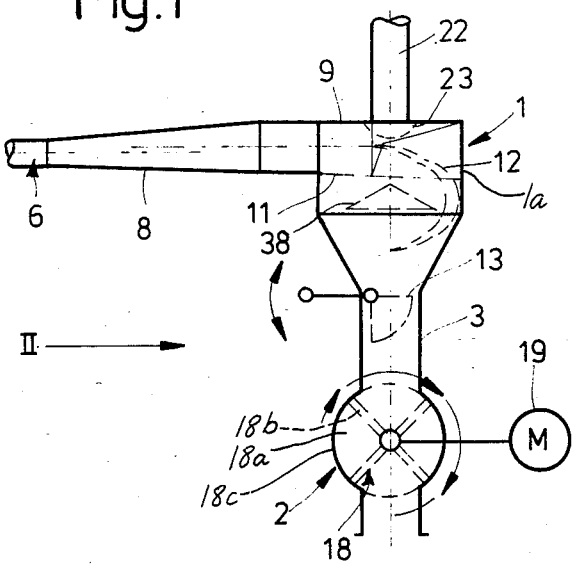
Fig.2
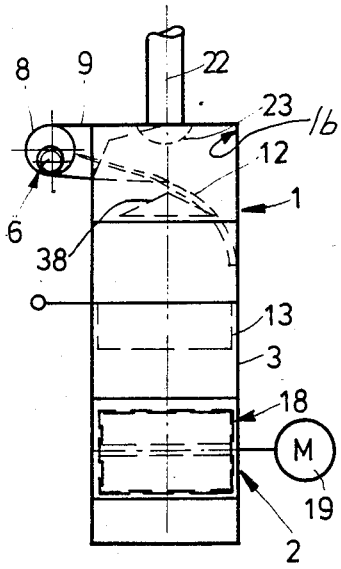
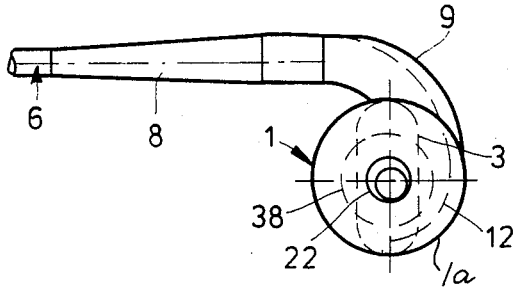
Fig.3

52
47
56
49
57
58
48
59
a
d
b
c
51
61
62
162
24
27
26
54
32
31
53
136
37
22
36
33
SOURCE OF COMPRESSED AIR
34
23
1
6
8
17
13
229
129
3
18
28
14
16
M
19
29
21
42
5
4
43
41
44
7
39
46

APPARATUS FOR SUPPLYING PARTICULATE MATERIAL TO TOBACCO PROCESSING MACHINES AND THE LIKE

BACKGROUND OF THE INVENTION

The present invention relates to apparatus for supplying particulate material to tobacco processing and analogous machines. For example, the apparatus of the present invention can be utilized to supply fragments of tobacco leaves to the distributor of a cigarette rod making machine. The term "particulate material" is intended to embrace all kinds of particulate materials which can be transported in a gaseous carrier medium, and such material includes shredded tobacco, otherwise fragmentized tobacco leaves, fragments of tobacco ribs, fragments of reconstituted tobacco as well as all kinds of smokable tobacco substitute materials.

It is well known to supply shredded or otherwise comminuted tobacco from a source of supply to the magazine of the distributor of a cigarette rod making machine by resorting to a pneumatic conveyor which draws particles of tobacco from the source and contains a suitable segregating device which separates the entrained solid particulate material from the gaseous carrier medium. It is desirable to operate the supplying apparatus in such a way that the magazine of the processing machine, such as the aforementioned cigarette rod making machine, invariably contains a substantially constant supply of particulate material. It is further preferred to supply relatively small quantities of particulate material at a relatively high frequency rather than resorting to admission of large batches of particles at less frequent intervals because the level of the supply of particulate material in the magazine is more constant if the material is admitted more or less continuously and in such a way that the quantity of stored material on admission of a batch does not undergo a pronounced change. It has been discovered that a cigarette rod making machine is much more likely to produce a relatively thin and homogeneous layer of tobacco particles, which can be readily converted into a rod-like filler of constant density and diameter, if the particles of tobacco are drawn from a magazine wherein the level of the supply of tobacco particles is constant or fluctuates within a narrow range. Measurements indicate that the weight of rod-shaped smokers' products is much more uniform if the magazine in the distributor of the cigarette rod making machine contains a substantially constant supply of tobacco particles.

A modern cigarette rod making machine can turn out many thousands of plain cigarettes per minute. Consequently, the pneumatic conveyor which delivers comminuted tobacco to the magazine of the distributor of such machine must convey the particles of tobacco at a very high rate. However, the output of a pneumatic conveyor cannot be increased at will because particles of tobacco are likely to be damaged if the speed of the gaseous carrier medium exceeds a certain maximum acceptable value. For example, pneumatic transport at an excessive speed can entail comminution of larger particles so that the product contains an excessive percentage of shorts and dust. Moreover, if the speed of the gaseous carrier medium is increased above a certain value, the carrier medium is likely to effect a highly undesirable classification of conveyed particles, namely segregation of comminuted tobacco ribs from shredded tobacco leaf laminae. Such classification is undesirable because it reduces the homogeneousness of the tobacco filler which is draped into a web of cigarette paper to form a cigarette rod ready to be subdivided into plain cigarettes of unit length or multiple unit length. Still further, if the gaseous carrier medium is caused to flow at an excessive speed, particles of dust and short tobacco, which should not enter the magazine of the distributor in a cigarette rod making machine, cannot be readily separated from the heavier and larger (satisfactory) tobacco particles so that the segregating action is less than satisfactory as soon as the speed of the carrier medium exceeds the aforementioned maximum permissible value. It should be borne in mind that one of the important reasons for entraining tobacco particles from the source to the consumer by pneumatic means is the possibility of simultaneously and reliably segregating dust and shorts from more acceptable particulate material.

OBJECTS AND SUMMARY OF THE INVENTION

An object of the invention is to provide a novel and improved apparatus which can transport all kinds of particulate material at a predictable rate, gently and in quantities which are required in a modern high-speed processing machine, such as a cigarette rod making machine which is designed to turn out up to and even in excess of 8000 plain cigarettes per minute.

Another object of the invention is to provide an apparatus which can deliver particulate material at a rate which fluctuates within a wide range if such fluctuation is desirable or necessary, and which can be installed in existing tobacco processing and other types of plants without necessitating appreciable alterations in the design and/or mode of operation of machines which supply particulate material thereto and/or which receive particulate material therefrom.

A further object of the invention is to provide a novel and improved method of regulating the speed of the gaseous carrier medium which is utilized in the above outlined apparatus to transport fragments of tobacco leaves or the like from a suitable source of supply to the consuming station or stations.

An additional object of the invention is to provide an apparatus which can reliably segregate dust and shorts from acceptable fragments of tobacco leaves while the acceptable material is in the process of being transported at any one of a wide variety of different rates.

Still another object of the invention is to provide the apparatus with novel and improved means for regulating the rate of transport of particulate material as a function of the momentary requirements of the processing machine or machines.

An additional object of the invention is to provide the apparatus with novel and improved pneumatic conveyor means.

Another object of the invention is to provide the apparatus with novel and improved means for segretating satisfactory particulate material from the gaseous carrier medium.

Another object of the invention is to provide the apparatus with novel and improved means for periodically cleaning or unclogging the pneumatic conveyor so as to ensure predictable operation for practically unlimited periods of time.

Still another object of the invention is to provide a novel and improved control system for the above outlined apparatus.

A further object of the invention is to provide an apparatus which is not only simpler and more compact but is also more reliable than heretofore used apparatus for the transport of comminuted tobacco leaves to the magazine of the distributor in a cigarette rod making machine.

The invention is embodied in an apparatus for supplying particulate material, such as portions of tobacco leaves, to a consuming machine (e.g., a cigarette rod making machine). The apparatus comprises a source of particulate material, a pneumatic conveyor having inlet means adjacent to the source of particulate material and outlet means, suction generating means connected with the outlet means so as to draw a stream of air through the conveyor whereby the air stream entrains particulate material from the source, a cyclone separator which is installed in the conveyor to segregate particulate material from the air stream, and evacuating means which is arranged to receive segregated particulate material from the cyclone separator. The evacuating means can comprise an intermittently operated cell wheel evacuator. Furthermore, the apparatus comprises a magazine (for example, an upright duct) which serves to receive particulate material from the evacuating means. A duct can be interposed between the cyclone separator and the evacuating means to deliver separated material to the evacuating means by gravity feed. Furthermore, the apparatus can comprise a gate which is installed in or close to the duct and means for moving the gate between first and second positions in which the gate respectively permits and prevents the descent of separated material into the evacuating means. The evacuating means can comprise a mobile (preferably indexible) evacuating member (e.g. a paddle wheel), and such apparatus preferably further comprises a motor which is actuatable to move the evacuating member whereby such member discharges particulate material from the evacuating means into the aforementioned magazine (for example, by gravity flow). The apparatus then preferably further comprises means for actuating the motor for the mobile evacuating member so that the gate assumes the second position and prevents entry of particulate material into the evacuating means while the motor moves the evacuating member for the purpose of discharging particulate material into the magazine.

The apparatus preferably further comprises means for decelerating the air stream in the conveyor upstream of the cyclone separator. Such decelerating means can comprise an elongated tubular diffusor which forms part of the pneumatic conveyor and is disposed between the inlet means and the cyclone separator and diverges toward the cyclone separator. The length of such diffusor is preferably a multiple (for example, ten times) of the diameter of the conveyor.

The pneumatic conveyor preferably further comprises an arcuate tubular section which serves to admit the air stream into the cyclone separator. The latter comprises a chamber and a cylindrical wall which surrounds the chamber and is connected with the arcuate section of the pneumatic conveyor. The radius of curvature of the arcuate section preferably exceeds the radius of the cylindrical wall of the cyclone separator. Such arcuate section is preferably disposed downstream of the diffusor and discharges the air stream, as well as the particulate material in the air stream, directly into the chamber of the cyclone separator. The aforementioned cylindrical wall of the cyclone separator is preferably an upright wall and its internal surface can be provided with at least one substantially helical guide element in the form of a vane which serves to guide separated particulate material along a downwardly sloping path leading into the aforementioned duct which connects the tobacco outlet of the cyclone separator with the evacuating means. A suitable intercepting device can be installed between that outlet of the cyclone separator which discharges the air stream and the outlet for discharge of segregated particulate material into the duct. The purpose of the intercepting device is to prevent particulate material from flowing with the air stream toward the respective outlet of the cyclone separator. The outlet for the air stream is preferably located at a level above the outlet for particulate material, and the intercepting device can include a baffle having a concave side which faces the outlet for particulate material.

The apparatus preferably further comprises a level monitoring device which generates signals denoting the quantity of particulate material in the magazine, an adjustable air flow throttling device which is installed in the conveyor between the cyclone separator and the outlet means of the pneumatic conveyor, and means for adjusting the throttling device in response to such signals. This conforms the rate of delivery of particulate material to the requirements of the machine which receives particulate material from the magazine. A normally open shutoff valve can be installed in the conveyor between the throttling device and the cyclone separator. Such apparatus preferably further comprises means for generating second signals which denote the pressure of air in the conveyor between the source of particulate material and the cyclone separator and/or between the cyclone separator and the suction generating means, and means for closing the valve in response to second signals when the pressure in the conveyor is outside of a preselected range, for example, when the pressure is such as to denote a clogging of the pneumatic conveyor. A source of compressed gaseous fluid (normally air) can be provided to admit a blast of compressed gaseous fluid into the pneumatic conveyor between the shutoff valve and the corresponding outlet of the cyclone separator when the shutoff valve is closed. This is desirable and advantageous if the cyclone separator contains a sieve or screen through which the air stream must flow on its way toward the outlet means and the suction generating device. The sieve is gradually clogged by particulate material and the blast of compressed air (while the shutoff valve is closed) ensures that the sieve is again fully permeable to air before the shutoff valve is caused to open.

The inlet means of the pneumatic conveyor can include a tubular portion which is movable relative to the source of particulate material to thereby vary the rate of admission of particulate material into the conveyor. Means can be provided to move the tubular portion of the conveyor relative to the source of particulate material in response to signals from the aforementioned level monitoring device so that the rate of admission of particulate material into the tubular portion of the pneumatic conveyor conforms to the momentary requirements of the machine including the magazine.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic side elevational view of a portion of the pneumatic conveyor, cyclone separator and evacuating means which form part of the improved apparatus;

FIG. 2 is an end elevational view as seen in the direction of arrow II in FIG. 1;

FIG. 3 is a plan view of the structure which is shown in FIGS. 1 and 2; and

DESCRIPTION OF THE PREFERRED EMBODIMENTS

Figure 4:
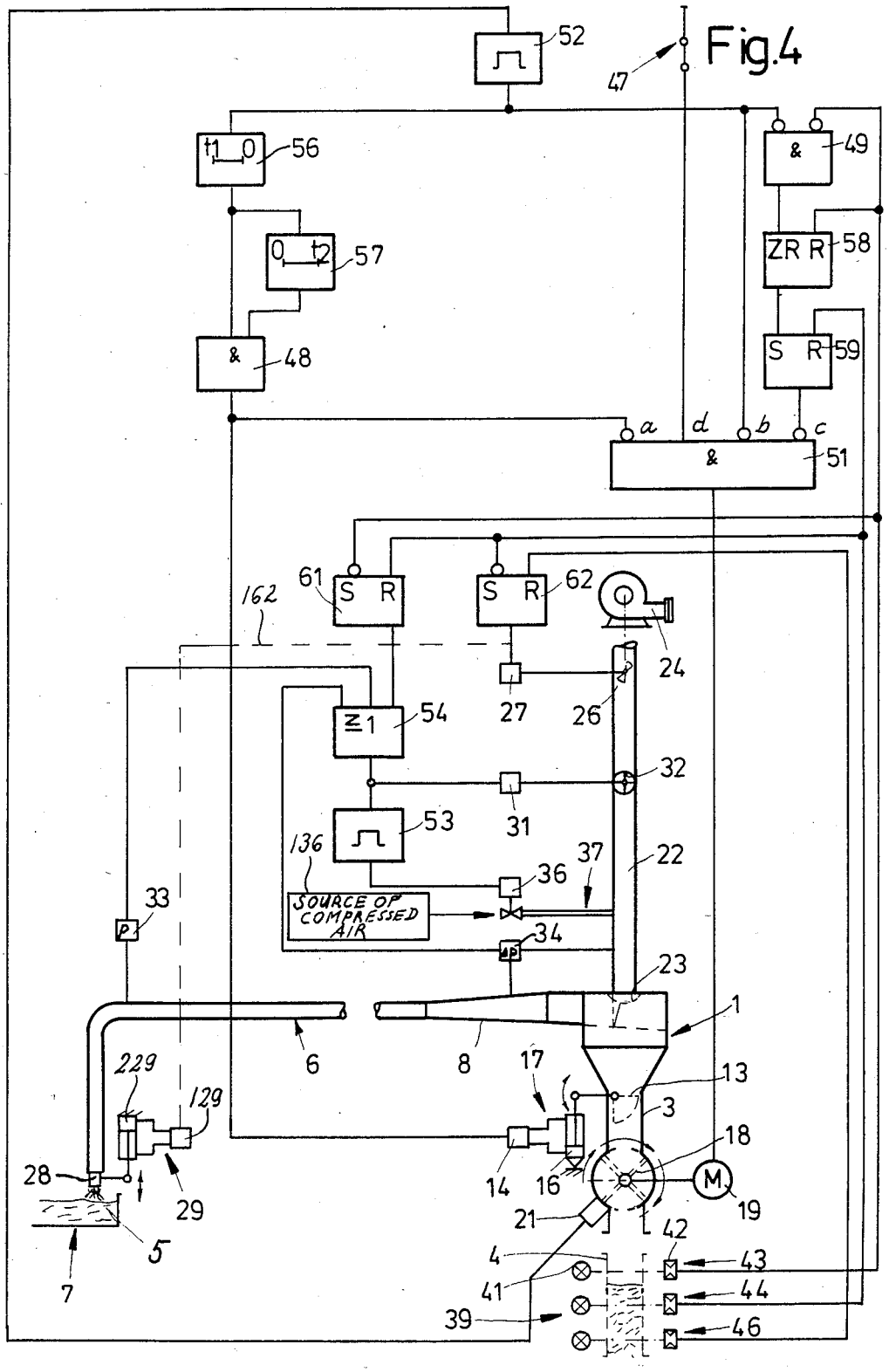
FIG. 4 is a smaller-scale view of the entire apparatus, further showing the control circuit therefor.

Referring to FIGS. 1 to 4, there is shown an apparatus which serves to supply the magazine 4 (see FIG. 4) of the distributor in a cigarette rod making machine with particles 5 of tobacco which is being withdrawn from a source 7. The apparatus comprises a pneumatic conveyor 6 having an intake end disposed at a level above the supply of tobacco particles 5 in the source 7 and an outlet which is connected to the suction intake of a suction generating device 24 in the form of a blower. The apparatus further comprises a cyclone separator 1 which is installed in the pneumatic conveyor 6, a vertical gravity duct 3 which connects the lower (tobacco) outlet of the separator 1 with an evacuating device 2 in the form of a cell wheel, and a motor 19 which can move (index) the wheel 18 of the evacuating device 2. The cyclone separator 1 and evacuating device 2 are installed in a common housing which also includes the duct 3. The magazine 4 forms part of the distributor in a cigarette rod making machine, for example, a machine known as SE 80 which is produced and sold by the assignee of the present application. The source 7 of tobacco particles 5 can constitute or include a vibrating trough which is designed to move up and down at a selected frequency so as to loosen the supply of tobacco particles 5 therein and to maintain such particles in a state of suspension for convenient withdrawal by the stream of air which is drawn through the conveyor 6 by the suction generating device 24.

In accordance with a feature of the invention, the pneumatic conveyor 6 comprises an elongated tubular section 8 which constitutes a diffusor and is disposed upstream of the cyclone separator 1, as considered in the direction of flow of the air stream from the intake end of the conveyor toward the suction generating device 24. The section 8 diverges in a direction toward the cyclone separator 1 and its length is a multiple of its diameter, for example, approximately 10 times the diameter of the conveyor 6. Furthermore, and as shown on FIG. 3, the section 8 does not discharge directly and substantially tangentially into the cylindircal wall 1*a* of the separator 1 but rather merges into an arcuate tubular section 9 having a radius of curvature greater than the radius of the wall 1*a*. The section 9 also diverges in a direction toward the inlet of the cyclone separator 1, and its bottom wall 11 is preferably inclined so as to correspond to or approximate the inclination of the ballistic trajectory of tobacco particles 5 which enter the chamber 1*b* within the confines of the cylindrical wall 1*a* of the separator 1. The internal surface of the wall 1*a* is provided with a helically extending downwardly sloping guide vane 12 which directs the segregated tobacco particles 5 toward the upper end of the duct 3. As can be seen in the drawing, the guide vane 12 can begin in the interior of the arcuate section 9 of the pneumatic conveyor 6 and can terminate short of the upper end of the duct 3.

The common housing for the cyclone separator 1 and evacuating device 2 further mounts a pivotable flap 13 which constitutes a gate for sealing at times the lower outlet of the cyclone separator and for then intercepting the segregated tobacco particles 5 before they can enter the duct 3. The flap 13 can be pivoted between the horizontal (closed) and open (vertical) positions by an actuating or adjusting device 17 including a double-acting pneumatic cyclinder and piston unit 16 and solenoid-operated valve means 14. The purpose of the flap 13 is to intercept at certain times particles of tobacco 5, e.g., while the evacuating device 2 is in the process of discharging one or more batches of tobacco particles into the magazine 4 of the distributor in the cigarette rod making machine. This ensures that the evacuating device 2 can discharge accurately metered quantities of tobacco particles, namely quantities which can fill successive cells 18*a* between the radially extending paddles or vanes 18*b* of the rotor or wheel 18 constituting the evacuating member 18 of the device 2. As mentioned before, the wheel 18 can be indexed, preferably intermittently, by the motor 19 which receives corresponding signals from an AND gate 51 of the control circuit shown in FIG. 4. The cylindrical shell 18*c* of the evacuating device 2 is adjacent to a suitable proximity detector 21 which can generate a signal whenever it is approached by the outermost portion of one of the radially extending vanes 18*b* of the wheel 18.

That portion of the pneumatic conveyor 6 which extends between the upper (air) outlet of the cyclone separator 1 and the suction generating device 24 is denoted by the reference character 22. The lower end portion of this conveyor portion is provided with a sieve or screen 23 which prevents larger particles of tobacco from advancing upwardly toward the suction generating device 24 but is designed to permit the passage of dust, small tobacco particles including the so-called shorts, and the stream of gaseous carrier medium. The portion 22 of the conveyor 6 accommodates a pivotable air flow throttling device 26 which can be caused to change its angular position by an adjusting device 27 so that it can assume at least two different angular positions, namely a position in which it permits at least substantially unobstructed flow of air toward the suction generating device 24 and a position in which the flow of air is obstructed to a greater extent.

The throttling device 26 can be provided in addition to or in lieu of a tubular member 28 at the intake end of the pneumatic conveyor 6 and an adjusting device 29 which can change the level of the lower end of the tubular member 28. The adjusting device 29 can be similar to the adjusting device 17 and can receive appropriate signals from a memory 62 whose output is also connected with the adjusting device 27. The arrangement is such that, when the coneyor 6 is to draw a larger quantity of tobacco particles 5 from the source 7, the adjusting device 29 lowers the tubular member 28 so as to move its open tobacco receiving end closer to the upper level of the supply of tobacco particles in the source 7. The character 129 denotes a solenoid valve means which regulates the flow of a pressurized fluid to and from the chambers of a double-acting cylinder and piston unit 229 for the tubular member 28.

The portion 22 of the pneumatic conveyor 6 further contains a shutoff valve 32 which can be moved between closed and open positions by an adjusting device 31. The valve 32 is disposed between the upper (air) outlet of the cyclone separator 1 and the throttling device 26.

The pressure in the interior of the pneumatic conveyor 6 upstream of the cyclone separator 1 is monitored by a pressure monitoring device 33 which can transmit appropriate signals to the corresponding input of an OR gate 54 forming part of the control circuit for the tobacco supplying apparatus. A similar pressure monitoring device 34 is provided to measure the pressure in the portion 22 of the pneumatic conveyor 6. The output of the monitoring device 34 is connected to a second input of the OR gate 54. The arrangement is preferably such that the monitoring device 34 ascertains the difference between the pressures prevailing in the conveyor portion 22 and diffusor 8 and transmits to the corresponding input of the OR gate 54 a signal which denotes the difference between such pressures.

Still further, the apparatus comprises a source 136 of compressed air which is connected with the pneumatic conveyor 6 by a conduit 37 merging into the portion 22 between the upper outlet of the cyclone separator 1 and the shutoff valve 32. The conduit 37 contains a solenoid-operated valve 36 which constitutes a means for selectively permitting or preventing the admission of compressed air into the portion 22 of the conveyor 6. The purpose of admitted compressed air is to flow downwardly into the cyclone separator 1 while the shutoff valve 32 is closed and to thus expel particles of tobacco, if any, from the interstices of the sieve 23 at the intake end of the conveyor portion 22.

As can be seen in FIGS. 1 and 2, the cylindrical wall 1*a* of the cyclone separator 1 surrounds a substantially conical intercepting device or baffle 38 which is disposed between the upper outlet (in the region of the sieve 23) and the lower outlet (in the region of the flap 13) of the cyclone separator 1. The purpose of the intercepting device 38 is to prevent segregated satisfactory particles of tobacco from ascending in the chamber 1*b* toward and from clogging the sieve 23. The underside of the intercepting device 38 is preferably bounded by a concave surface on which the ascending satisfactory particles 5 rebound and are thus caused to descend toward and into the duct 3.

The level of the supply of tobacco particles 5 in the magazine 4 of the distributor is monitored by a level detector 39 which includes three photocells 43, 44 and 46 disposed at three different levels. Each photocell comprises a source 41 of radiation and a transducer 42. A level detector which is similar to the detector 39 is disclosed, for example, in commonly owned U.S. Pat. Nos. 4,172,515 and 4,223,845. A distributor which can receive tobacco particles from the apparatus of the present invention may be of the type disclosed in commonly owned U.S. Pat. No. 4,011,966.

The control circuit which is shown in FIG. 4 further comprises additional elements which will be described in greater detail during the next-following description of operation of the improved apparatus. Such additional elements comprise a starter switch 47 which can be actuated to transmit a signal to the corresponding input d of the AND gate 51. This gate further comprises the aforementioned output which is connected to the motor 19 for the rotor or wheel 18 of the evacuating device 2, and three inverting inputs a, b and c. The output of a second AND gate 48 is connected to the inverting input a of the AND gate 51 and to the solenoid valve means 14 of the adjusting device 17. A third AND gate 49 has two inverting inputs and its output is connected with a backward counter 58. The circuit of FIG. 4 further comprises two monostable multivibrators 52 and 53 each of which is designed to transmit an output signal for a certain period of time independently of the duration of the received input signal. The aforementioned OR gate 54 has three inputs including the two aforediscussed inputs receiving signals from the pressure monitoring devices 33, 34 and a third input connected to the output of a memory 61. A time-delay unit 56 is designed to transmit a signal to the corresponding input of the AND gate 48 and to the input of a second time-delay unit 57. Such signal disappears as soon as the transmission of a signal to the input of the time-delay unit 56 is terminated. The transmission of signal from the output of the time-delay unit 56 is delayed with respect to the transmission of signal to its input. The construction of the time-delay unit 57 is such that its output transmits a signal for a certain interval of time following the interruption of admission of a signal to its input from the output of the time-delay unit 56. The circuit of FIG. 4 further comprises a third memory 59. Each of the memories 61, 62 has an inverting input. The other input of the memory 61 receives signals from the transducer of the photocell 44, and the other input of the memory 62 receives signals from the transducer of the photocell 46.

The mode of operation of the apparatus which is shown in FIGS. 1 to 4 is as follows:

In the first step, an attendant actuates the starter switch 47 to transmit a signal to the input d of the AND gate 51. It is assumed that the upper level of the supply of tobacco particles 5 in the magazine 4 is between the photocells 44 and 46, i.e., the transducers of the photocells 43 and 44 transmit signals to the inputs of the elements (49, 61 and 59, 62) which are connected thereto. The motor of the suction generating device 24 is on so that its intake draws a stream of air into the portion 22 of the pneumatic conveyor 6. Such air stream enters the conveyor 6 by way of the tubular member 28 and draws particles 5 of tobacco from the source 7 into the cyclone separator 1. The diffusor 8 of the conveyor 6 reduces the speed of the air stream and of tobacco particles 5 therein to such an extent that dust and unacceptable or undesirable smaller particles of tobacco remain in the air stream which flows through the sieve 23 and into the portion 22 of the conveyor 6. The solid particulate material which flows with the air stream into and through the portion 22 of the conveyor 6 is segregated from air in a manner which is not shown in the drawing because it forms no part of the present invention. It will be noted that, in direct contrast to the operation of heretofore known and used cyclone separators, the segregating action of the separator 1 in the conveyor 6 is not very pronounced but suffices to ensure reliable segregation of all satisfactory tobacco particles from the gaseous carrier medium, dust and smaller tobacco particles so that the space above the then closed flap 13 accumulates only high-grade material which is best suited for the making of a satisfactory tobacco filler. Thus, segregation of undesirable solid particulate material from satisfactory fragments of tobacco leaves takes place in the cyclone separator 1 due, to a considerable extent, to the speed-reducing action of the diffusor 8 upstream of the cyclone separator. Moreover, deceleration of the air stream and of the solid particulate material therein ensures that the particles of tobacco are treated gently on their way through the cyclone separator 1 and into the duct 3 (when the flap 13 is held in the open position). Gentle treatment of tobacco particles is further enhanced due to the provision of the arcuate tubular section 9 whose radius of curvature exceeds that of the cylindrical wall 1*a* of the separator 1. The arcuate section 9 ensures that deflection of tobacco particles from the outlet of the diffusor 8 into the chamber 1*b* of the separator 1 takes place softly, i.e., the transition from a straight path which is defined by the diffusor 8 into a helical path which is defined by the wall 1*a* and its guide vane 12 is smooth and gradual with attendant pronounced reduction of the likelihood of comminution of larger tobacco particles and the resulting generation of additional dust and/or short tobacco. The vane 12 guides the satisfactory particles of tobacco downwardly along the aforementioned helical path and the particles are propelled beyond the lower edge face of the vane 12 to enter the space above the flap 13. If desired, the wall 1*a* of the cyclone separator 1 can be provided with different and/or additional guide means for directing satisfactory tobacco particles from the inlet of the separator 1 toward the lower outlet, i.e., toward the outlet by way of which the satisfactory particles of tobacco enter the duct 3.

The baffle 38 in the chamber 1*b* of the cyclone separator 1 reduces the likelihood of ascent of satisfactory tobacco particles from the space above the closed flap 13 or from the interior of the duct 3 toward the upper outlet which receives the sieve 23. If a satisfactory particle exhibits the tendency to rise in the cyclone separator 1, it is highly likely to impinge against the concave underside of the baffle 38 and to thereby lose energy so that it drops onto the flap 13 or into the duct 3.

As stated above, it is assumed that, during the aforedescribed stage of operation of the improved apparatus, the flap 13 is held in the closed (horizontal) position by the piston rod of the double-acting cylinder and piston unit 16 which forms part of the adjusting device 17. It is further assumed that the uppermost cell 18*a* of the wheel 18 in the evacuating device 2 is filled with satisfactory tobacco particles, the same as the immediately preceding cell 18*a* (as considered in the direction of rotation of the wheel 18 when the motor 19 is on). At such time, all four inputs a to d of the AND gate 51 receive signals so that this gate transmits a signal to the motor 19. The input a receives a signal because it is an inverting input and the output of the AND gate 48 does not transmit a signal. The input b receives a signal because it is an inverting input and the output of the monostable multivibrator 52 does not transmit a signal. The input c receives a signal because it is an inverting input and the output of the memory 59 does not transmit a signal, and the input d receives a signal in view of the aforementioned actuation of the starter switch 47. The motor 19 indexes the wheel 18 of the evacuating devcie 2 through 90 degrees in a clockwise direction, as viewed in FIG. 4, so that the foremost filled cell 18*a* discharges its contents into the magazine 4. The proximity detector 21 then transmits a signal because it is approached by the oncoming vane 18*b* of the wheel 18, and such signal activates the monostable multivibrator 52. The latter then transmits a signal for a certain interval of time with the result that the signal at the output of the AND gate 51 disappears for the same interval of time because the signal at the output of the element 52 is inverted at the input b of the AND gate 51. The motor 19 is disconnected from its energy source and the wheel 18 comes to a halt. At the same time, the output of the monostable multivibrator 52 transmits a signal to the time-delay unit 56 whose output transmits a signal, with a preselected delay, to the corresponding input of the AND gate 48. The signal at the output of the time-delay unit 56 is further transmitted to the input of the time-delay unit 57 whose output transmits a signal to the other input of the AND gate 48. The signal at the output of the AND gate 48 then energizes the solenoid valve means 14 which causes the unit 16 of the adjusting device 17 to move the flap 13 to the open (vertical) position so that a batch of accumulated tobacco particles can descend into the duct 3 and thence into the upwardly facing empty cell 18*a* of the wheel 18.

The signal at the output of the time-delay unit 57 disappears after a certain interval of time so that the solenoid valve means 14 is deenergized and the unit 16 returns the flap 13 to the closed (horizontal) position. The sum of intervals $t_1$ and $t_2$ during which the outputs of the time-delay units 56 and 57 transmit signals to the corresponding inputs of the AND gate 48 is shorter than the interval of energization of the monostable multivibrator 52. This invariably ensures that the flap 13 reassumes its closed position before the motor 19 is started again. It will be recalled that the AND gate 51 cannot transmit a signal to the motor 19 as long as the inverting input b of this gate receives a signal from the output of the monostable multivibrator 52. If the signal from the proximity detector 21 disappears prematurely, the flap 13 immediately returns to the closed position because the signal at the output of the monostable multivibrator 52 disappears together with the signal at the output of the time-delay unit 56 and at the corresponding input b of the AND gate 51.

The signal at the output of the monostable multivibrator 52 disappears after a certain interval of time irrespective of whether or not its input continues to receive a signal from the proximity detector 21. At such time, the output of the AND gate 51 again transmits a signal to the motor 19 which indexes the wheel 18 through 90 degrees and effects the transfer of a further batch of tobacco particles from the foremost filled cell 18*a* into the magazine 4.

If the sieve 23 is clogged with tobacco particles, the pressure differential between the interior of the conveyor portion 22 and the diffusor 8 increases, and this is detected by the monitoring device 34 which transmits an appropriate signal to the corresponding input of the OR gate 54. Consequently, the output of the OR gate 54 transmits a signal to the adjusting device 31 which moves the normally open shutoff valve 32 to closed position. At the same time, the signal at the output of the OR gate 54 activates the monostable multivibrator 53 whose output transmits a signal for a preselected interval of time, and such signal causes the valve 36 to open so that the portion 22 of the conveyor 6 receives a blast of compressed air from the source 136 via conduit 36 and such air flows downwardly, as viewed in FIG. 4, because the shutoff valve 32 is already closed. This automatically expels particles of tobacco and/or other clogging material from the interstices of the sieve 23. As soon as the sieve 23 is free to again permit the flow of air at a required rate, the signal from the pressure monitoring device 34 disappears and the OR gate 54 ceases to transmit a signal to the adjusting device 31 which opens the shutoff valve 32. The signal at the output of the monostable multivibrator 53 disappears not later than the signal at the output of the OR gate 54 so that the valve 36 is closed and the admission of compressed air into the portion 22 of the conveyor 6 is terminated not later than on opening of the valve 32.

If the supply of tobacco particles in the magazine 4 rises (e.g., because the cigarette rod making machine whose distributor includes the magazine 4 is operated at less than normal speed or is arrested for a certain interval of time) to such an extent that the particles of tobacco in the magazine 4 interrupt the light beam between the light source and the transducer of the median photocell 44 of the level monitoring device 39, the inverting left-hand input S of the memory 62 transmits a signal while the input R of this memory does not receive a signal from the transducer of the photocell 46. The memory 62 then transmits a signal to the adjusting device 27 which changes the angular position of the air flow throttling device 26 so that the rate of air flow through the conveyor 6 is reduced accordingly, i.e., the conveyor 6 delivers tobacco to the cyclone separator 1 at a correspondingly reduced rate. Alternatively to such adjustment of the throttling device 27 in response to a signal from the transducer of the photocell 44, or in addition to such adjustment, the output of the memory 62 can transmit a signal via conductor means 162 (shown in FIG. 4 by broken line because optional), to the adjusting device 29 whose unit 229 lifts the tubular member 28 of the conveyor 6 to a level further away from the supply of tobacco particles 5 in the source 7 so that the rate of admission of such particles into the conveyor 6 is reduced accordingly. Thus, the rate of tobacco delivery to the cyclone separator 1, and thence to the duct 3 and evacuating device 2, can be reduced in more than a single way whenever the level of the tobacco supply in the magazine 4 rises to an extent which warrants a reduction of the rate of tobacco delivery to the cyclone separator 1.

If the supply of tobacco particles in the magazine 4 drops below the level of the light source and transducer of the lowermost photocell 46 of the level monitoring device 39, the transducer of the photocell 46 transmits a resetting signal to the input R of the memory 62. The signal at the output of the memory 62 then disappears and the adjusting device 27 restores the original (open) position of the throttling device 26 so that the conveyor 6 is again in a position to draw tobacco particles 5 from the source 7 at the normal or higher rate. At the same time or alternatively, the signal at the input of the valve means 129 of the adjusting device 29 also disappears so that the tubular member 28 in the inlet of the conveyor 6 is lowered and can draw a larger quantity of tobacco particles per unit of time.

If the tubular member 28 become clogged with tobacco particles and/or other solid material (e.g., by a clump of coherent tobacco particles which is lifted out of the source 7), the pressure in the conveyor 6 decreases because the suction generating device 24 is on. The pressure monitoring device 33 then transmits a signal to the OR gate 54 which causes the adjusting device 31 to close the shutoff valve 32. This entails a rise of pressure in the conveyor 6 upstream of the cyclone separator 1 to atmospheric pressure so that the material which has clogged the tubular member 28 descends by gravity back into the source 7.

If the supply of tobacco particles 5 in the magazine 4 rises to a level such that the light beam between the source 41 and the transducer 42 of the uppermost photocell 43 of the level monitoring device 39 is interupted, the transducer 42 ceases to transmit a signal to the inverting input S of the memory 61 whose output then transmits a signal to the OR gate 54 in order to move the shutoff valve 32 to closed position by way of the adjusting means 31. This interrupts the delivery of tobacco from the source 7 to the chamber **1*b* of the cyclone separator 1. At the same time, the signal at the output of the OR gate 54 induces the monostable multivibrator 53 to effect an opening of the valve 36 so that the conduit 37 admits a blast of compressed air which cleans the sieve 23 at the inlet of the conveyor portion 22 in automatic response to an interruption of the delivery of tobacco particles to the cyclone separator 1**.

In order to evacuate the contents of the cyclone separator 1 and cells **18*a* when the delivery of tobacco particles 5 from the source 7 is interrupted, the wheel 18 of the evacuating device 2 is indexed a certain number of times upon closing of the valve 32. This is accomplished in the following way: The AND gate 49 transmits a signal to the input ZR of the backward counter 58 when the signal at the output of the monostable multivibrator 52 disappears and the transducer 42 of the photocell 43 does not transmit a signal to the right-hand inverting input of the gate 49. This is due to the fact that both inputs of the gate 49 are inverting inputs. The counter 58 is then activated because it receives a signal from the output of the gate 49. This counter transmits a signal to the input S of the memory 59 when it receives a preselected number of signals from the output of the AND gate 49. The memory 59 then transmits a signal to the inverting input c of the AND gate 51 so that the signal at the output of the gate 51 disappears and the motor 19 is idle. If the transducer 42 of the photocell 43 begins to transmit a signal before the counter 58 has received a selected number of signals, the transducer 42 transmits a signal to the resetting input R of the counter 58 so that the latter is reset to zero. If the transducer of the photocell 44 thereupon begins to transmit a signal, such signal resets the memory 59 and the AND gate 51 is again free to transmit a signal to the motor 19 in order to index the wheel 18. At the same time, the signal which is generated by the transducer of the photocell 44 resets the memory 61 so that the latter ceases to transmit a signal to the OR gate 54 whereby the adjusting device 31 is free to open the shutoff valve 32 and the suction generating device 24 can draw an air stream through the conveyor 6 so that the latter resumes the delivery of tobacco particles 5 into the cyclone separator 1**.

The flap 13 in the housing of the cyclone separator 1 and evacuating device 2 constitutes an optional but desirable feature of the improved apparatus. This flap promotes the reliability and predictability of operation in that it prevents continuous flow of segregated satisfactory tobacco particles 5 into the duct 3 and thence into the topmost cell **18*a* of the wheel 18. The location of the flap 13 can be shifted further down toward or into the discharge end of the duct 3 without departing from the spirit of the invention. As mentioned above, the flap 13 is or can be closed while the motor 19 is on to index the wheel 18 and to effect the transfer of a batch of tobacco particles from the foremost filled cell 18*a* into the magazined 4**.

The provision of the diffusor 8 in that portion of the pneumatic conveyor 6 which extends between the tobacco source 7 and the cyclone separator 1 ensures that the kinetic energy of the air stream which carries the particles of tobacco into the chamber 1*b* is reduced with attendant reduction of the eddy current which is formed by the tobacco conveying gaseous carrier medium in the chamber 1*b* of the separator 1. This, in turn, ensures gentle treatment of tobacco particles during their segregation from the gaseous carrier medium and during transport toward and into the duct 3. As mentioned above, deceleration of the air stream in the diffusor 8 upstream of the cyclone separator 1 reduces the effectiveness of the segregating action of the separator with the result that dust and unsatisfactory (smaller) tobacco particles are permitted to enter the portion 22 of the conveyor 6 and do not descend into the duct 3. Moreover, deceleration of air in the diffusor 8 ensures that the particles of tobacco can be segregated from air in the chamber 1*b* after having travelled along an arc of 360 degrees which contributes to compactness and simplicity as well as lower cost of the unit including the separator 1, evacuating device 2 and duct 3. Such relatively short path for effecting segregation of satisfactory tobacco particles from air is especially desirable if the designer wishes to assemble a relatively low unit, i.e., a unit wherein the height of the wall 1*a* is small in comparison with the height of such walls in conventional cyclone separators which are designed to separate all or nearly all solid particles from the gaseous carrier medium. As mentioned above, a diffusor whose length is approximately ten times the average diameter of the conveyor 6 has been found to be highly satisfactory in an apparatus which serves to supply a mixture of tobacco shreds and fragments of tobacco ribs to the distributor of a cigarette rod making machine.

An advantage of the arcuate tubular section 9 of the conveyor 6 is that it prevents abrupt penetration of tobacco particles from a straight or more or less straight path (in the conveyor 6 upstream of the cyclone separator 1) into the arcuate path which is defined by the internal surface of the cylindrical wall 1*a* and the helical vane 12. Thus, the trajectory of tobacco particles is changed gradually with attendant reduction of the likelihood of undesirable comminution of tobacco particles in the cyclone separator. The provision of a helical vane 12 or of analogous or equivalent guide means ensures predictable transport of tobacco particles through the housing of the cyclone separator 1 and more predictable (uniform) filling of that cell 18*a* which faces upwardly toward the lower end of the duct 3.

It has been found that the placing of the baffle 38 into the cyclone separator 1 greatly enhances the separation of dust and undesirable lightweight tobacco particles from the satisfactory particulate material. Thus, the ascending air stream is free to entrain dust and undesirable tobacco particles but is prevented from lifting those (satisfactory) particles of tobacco which have descended along the guide vane 12 and thereupon exhibit a tendency to rise toward the sieve 23 at the lower end of the conveyor portion 22. In other words, the baffle 38 enhances the specific function of the cyclone separator 1 in a cigarette rod making or analogous machine by enabling the cyclone separator to segregate satisfactory particulate material from but to enable the air stream to entrain all undesirable particulate material in a direction counter to that of evacuation of satisfactory material via duct 3 and device 2.

A cigarette rod making machine is normally equipped with a device which monitors the level of the supply of tobacco particles in the magazine of the distributor. This is desirable and advantageous because any pronounced fluctuations in the level of the tobacco supply in the magazine 4 are likely to adversely influence the quality of the rod-like tobacco filler by preventing the formation of a homogeneous thin tobacco layer which is thereupon converted into a narrow stream preparatory to conversion of the stream into the rod-like filler in a manner which is customary in modern high-speed cigarette rod making machines. As a rule, the operation of the tobacco supplying apparatus should be such that the level of the top surface of the supply of tobacco particles in the magazine 4 will remain at or close to an optimum median or average level. As explained above, a conventional level monitoring device can be utilized to regulate the position of the throttle 26 and/or the level of the tubular member 28 of the pneumatic conveyor 6 in order to increase or reduce the rate of tobacco delivery to the cyclone separator 1 and evacuating device 2 in dependency on changes in the level of the upper surface of the supply of tobacco particles in the magazine 4.

The pressure monitoring means 33 and 34, as well as the valves 32 and 36, also constitute optional but desirable and advantageous features of the improved apparatus. Thus, such devices can rapidly eliminate accumulations of tobacco particles at the underside of the sieve 23 and/or interrupt the delivery of tobacco particles to the cyclone separator 1 when the need for an interruption arises.

An important advantage of the improved apparatus is that its operation can be regulated with a high degree of predictability, accuracy and reproducibility. Moreover, the apparatus treats the satisfactory tobacco particles gently and automatically segregates from such particles all particulate material which is not supposed to enter the distributor of a cigarette rod making machine. The adjustments in the rate of tobacco delivery are automatic and invariably and rapidly conform to changes in the requirements of the processing machine or machines.

It is further clear that the improved apparatus can be used with equal or similar advantage for controlled transport of other types of particulate material in a gaseous carrier medium from a suitable source to one or more consuming or processing machines. For example, and as already mentioned above, the source 7 need not contain fragmentized natural tobacco leaves but can also contain a mixture of natural tobacco with reconstituted and/or artificial tobacco, only reconstituted tobacco, only artificial tobacco or any other particulate material which must be delivered to a machine at a controlled rate and in such a way that the material is not damaged on its way from the source to the consumer, that the material is classified according to size and/or quality in automatic response to segregation from the gaseous carrier medium and/or that the delivery is interrupted whenever the consumer is idle or operates at less than normal speed.

The parts of the control circuit which is shown in FIG. 4 are commercially available components. This also applies for the various pressure monitoring devices, adjusting means for the flap 13, tubular member 28, throttling device 26 and valves 32, 36, motor 19 and proximity detector 21.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for supplying particulate materials, such as portions of tobacco leaves, to a consuming machine, such as a cigarette rod making machine, comprising a source of particulate material; a pneumatic conveyor having inlet means adjacent to said source and outlet means; suction generating means connected with said outlet means to draw a stream of air through said conveyor whereby the air stream entrains particulate material from said source; a cyclone separator installed in said conveyor to segregate particulate material from the air stream; evacuating means arranged to receive segregated particulate material from said cyclone separator, said evacuating means comprising a mobile evacuating member; a motor actuatable to move said evacuating member whereby the latter discharges particulate material from said evacuating means; a duct interposed between said separator and said evacuating means and arranged to deliver separated material to said evacuating means by gravity feed; a gate installed in or close to said duct; means for moving said gate between first and second positions in which said gate respectively permits and prevents the descent of separated material into said evacuating means; and means for actuating said moving means so that said gate assumes said second position and prevents entry of particulate material into said evacuating means while said motor moves said evacuating member.

2. The apparatus of claim 1, wherein said evacuating means comprises an intermittently operated cell wheel evacuator.

3. The apparatus of claim 2, further comprising a magazine arranged to receive material from said evacuator.

4. The apparatus of claim 1, further comprising means for decelerating the air stream in said conveyor upstream of said cyclone separator.

5. The apparatus of claim 1, wherein said conveyor comprises an elongated tubular diffusor which is disposed between said inlet means and said cyclone separator and diverges toward said separator.

6. The apparatus of claim 5, wherein the length of said diffusor is a multiple of the diameter of said conveyor.

7. The apparatus of claim 1, wherein said conveyor comprises an arcuate tubular section arranged to admit the air stream into said cyclone separator, said separator having a chamber and a cylindrical wall surrounding said chamber and connected with said arcuate section, the radius of curvature of said arcuate section exceeding the radius of said wall.

8. The apparatus of claim 1, wherein said cyclone separator has a chamber arranged to receive the air stream and particulate material from said conveyor and a substantially upright tubular wall surrounding said chamber, said wall having an internal surface and including at least one at least substantially helical guide element provided at said inner side and arranged to guide separated particulate material along a downwardly sloping path.

9. The apparatus of claim 1, wherein said separator has an inlet for the air stream and particulate material, a first outlet for the air stream and a second outlet for particulate material, said second outlet being disposed opposite said first outlet and said separator further comprising means for intercepting particulate material which tends to advance by suction in a direction from said second outlet toward said first outlet.

10. The apparatus of claim 1, further comprising a magazine arranged to receive particulate material from said evacuating means, means for generating signals denoting the quantity of particulate material in said magazine, adjustable air flow throttling means installed in said conveyor between said cyclone separator and said suction generating means and means for adjusting said throttling means in response to said signals.

11. The apparatus of claim 10, wherein said signal generating means comprises a level detector.

12. The apparatus of claim 10, further comprising a normally open shutoff valve installed in said conveyor between said throttling means and said cyclone separator, means for generating second signals denoting the pressure of air in said conveyor between said source and said separator, and means for closing said valve in response to said second signals when the pressure in said conveyor is outside of a preselected range.

13. The apparatus of claim 10, further comprising a normally open shutoff valve installed in said conveyor between said throttling means and said cyclone separator, means for generating second signals denoting the pressure of air in said conveyor downstream of said separator, and means for closing said valve when the pressure in said conveyor is outside of a preselected range.

14. The apparatus of claim 1, further comprising a normally open shutoff valve installed in said conveyor downstream of said cyclone separator, means for generating signals denoting the pressure of air in said conveyor, and means for closing said valve when the pressure of air is outside of a predetermined range.

15. The apparatus of claim 14, further comprising a source of compressed gaseous fluid and means for admitting such fluid into said conveyor between said valve and said cyclone separator in response to closing of said valve.

16. The apparatus of claim 15, further comprising a sieve provided in said conveyor for the flow of separated air stream from said separator toward said suction generating means, said sieve being arranged to intercept particulate material whose size exceeds a certain value whereby the intercepted material exhibits the tendency to clog said sieve and to thereby change the pressure of air in said conveyor, said closing means being arranged to close said valve when the pressure in said conveyor is changed as a result of clogging of said sieve.

17. The apparatus of claim 1, wherein said inlet means includes a tubular portion which is movable relative to said source to thereby vary the rate of admission of particulate material into said conveyor.

18. The apparatus of claim 17, further comprising a magazine arranged to receive particulate material from said evacuating means, means for generating signals denoting the quantity of particulate material in said magazine, and means for moving said tubular portion relative to said source in response to said signals when the quantity of particulate material in said magazine is outside of a predetermined range.

19. Apparatus for supplying particulate material, such as portions of tobacco leaves, to a consuming machine, such as a cigarette rod making machine, comprising a source of particulate material; a pneumatic conveyor having inlet means adjacent to said source and outlet means; suction generating means connected with said outlet means to draw a stream of air through said conveyor whereby the air stream entrains particulate material from said source; a cyclone separator installed in said conveyor to segregate particulate material from the air stream, said separator having a chamber arranged to receive the air stream and particulate material from said conveyor and a substantially upright tubular wall surrounding said chamber, said wall having an internal surface and including at least one at least substantially helical guide element provided at said inner side and arranged to guide separated particulate material along a downwardly sloping path; and evacuating means arranged to receive segregated particulate material from said cyclone separator.

20. The apparatus of claim 19, further comprising a duct interposed between said separator and said evacuating means and arranged to deliver separated material to said evacuating means by gravity feed.

21. The apparatus of claim 20, further comprising a gate installed in or close to said duct and means for moving said gate between first and second positions in which said gate respectively permits and prevents the descent of separated material into said evacuating means.

22. The apparatus of claim 21, wherein said evacuating means includes a mobile evacuating member and further comprising a motor which is actuatable to move said evacuating member whereby the latter discharges particulate material from said evacuating means, and means for actuating said moving means so that said gate assumes said second position and prevents entry of particulate material into said evacuating means while said motor moves said evacuating member.

23. The apparatus of claim 19, wherein said guide element comprises a downwardly sloping helical vane.

24. Apparatus for supplying particulate material, such as portions of tobacco leaves, to a consuming machine, such as a cigarette rod making machine, comprising a source of particulate material; a pneumatic conveyor having inlet means adjacent to said source and outlet means; suction generating means connected with said outlet means to draw a stream of air through said conveyor whereby the air stream entrains particulate material from said source; a cyclone separator installed in said conveyor to segregate particulate material from the air stream, said separator having an inlet for the air stream and particulate material, a first outlet for the air stream and a second outlet for particulate material, said second outlet being disposed opposite said first outlet and at a level below said first outlet and said separator further comprising means for intercepting particulate material which tends to advance by suction in a direction from said second outlet toward said first outlet, said intercepting means including a baffle having a concave side facing said second outlet; and evacuating means arranged to receive segregated particulate material from said cyclone separator.

25. The apparatus of claim 24, wherein said second outlet is disposed at a level below said first outlet and said intercepting means includes a baffle having a concave side facing said second outlet.

* * * * *